United States Patent [19]

Coulter, Jr. et al.

[11] Patent Number: 4,986,211

[45] Date of Patent: Jan. 22, 1991

[54] TONING METHOD AND MEMBER FOR ELECTROSTATOGRAPHY

[75] Inventors: Joseph R. Coulter, Jr., Miami Springs, Fla.; Josef Matkan, Malvern, Australia

[73] Assignee: Coulter Systems Corporation, Bedford, Mass.

[21] Appl. No.: 404,170

[22] Filed: Sep. 7, 1989

[51] Int. Cl.[5] ..... B05B 5/025

[52] U.S. Cl. ..... 118/644; 118/645; 430/118; 430/101; 430/102; 430/103; 430/40; 355/256; 355/257; 355/259

[58] Field of Search ..... 430/118, 117, 101, 102, 430/103, 40, 41; 118/644, 645; 355/256, 257, 259

[56] References Cited

U.S. PATENT DOCUMENTS 2,901,374 8/1959 Gundlach ..... 430/102

*Primary Examiner*—J. David Welsh

*Attorney, Agent, or Firm*—Silverman, Cass & Singer, Ltd.

[57] ABSTRACT

A toning method and member for electrostatography wherein a recording member containing information on its image bearing surface in the form of electrostatic latent images of one polarity is toned by attracting to such latent images toner material of opposite polarity including providing a carrier or toning member according to the invention containing on at least one surface thereof a dry pre-toner coating; activating such pre-toner coating with an insulative solvent to thereby solvate and confer opposite polarity to such pre-toner coating contained thereon while rendering such pre-toner coating releasable from the carrier member; establishing virtual contact between the activated and releasable pre-toner coating on the carrier member and the image bearing surface of the recording member; transferring the pre-toner coating in image configuration onto the recording member by attraction to the latent images to form toner deposits thereon; and separating the carrier member from the recording member.

20 Claims, No Drawings

TONING METHOD AND MEMBER FOR ELECTROSTATOGRAPHY

FIELD OF THE INVENTION

This invention relates generally to electrostatography, and, more particularly, to a method of toning electrostatic latent images by means of a novel toning member.

BACKGROUND OF THE INVENTION

Electrophotography and electrostatic printing are well known image reproduction methods as is the reproduction of color images by these methods, for instance, in color copiers, color printers and color proofers.

In electrophotographic color copiers, the color original is projected onto a photoconductor sequentially through several color separation filters, such as blue, green and red. These filters separate the yellow, magenta and cyan color components of the original, respectively. Such color components then are sequentially toned on the photoconductor with toners of appropriate colors. The toner deposits then are sequentially transferred to a receptor to reproduce the original. In many instances, a black color also is used to enhance contrast.

The main difference between electrophotographic color printers and color copiers is that in color printers, the color original is scanned, the separated color components are electronically processed, digitized and stored if so desired. Such electronic data then is used to expose the photoconductor by means of a laser scanner.

In electrophotographic color proofing, the photoconductor is exposed sequentially to color separation films and toned sequentially with toners of appropriate colors. The color toner deposits then are transferred sequentially to a receptor, such as printing stock paper. Such pre-press color proofing processes are disclosed, for example, in U.S. Pat. Nos. 3,809,555 and 3,862,848. An apparatus for the production of electrophotographic pre-press proofs is described, for example, in U.S. Pat. Nos. 4,556,309 and 4,557,583.

It is known that for high image quality in electrophotographic color reproduction processes it is necessary to use fine particle size liquid toners. In certain such processes, for instance in color proofing, it is essential to have very uniformly filled in solid image areas. Additionally, the density of the image areas must be within narrow tolerances as specifically required over each proof and from proof to proof.

With liquid toners, however, it is necessary to operate at slow toning speeds in order to obtain uniform fill-in of solid images without any appreciable variation in the required image density. Variations in fill-in and density, at least in part, are caused by liquid toners being very sensitive to minor surface voltage or charge density variations on the photoconductor. These variations are common and result in differences in the rate of toner attraction.

Slow toning appears to compensate for such differences or variations, provided they are not more than about 5 to 7 percent of the nominal surface voltage. Slow toning, however, slows down the throughput and, for economic reasons, there is an obvious need for fast throughput.

The method of the invention provides virtually instantaneous liquid toning whereby complete fill-in of solid image areas at any required density can be obtained. Such toning virtually provides no variations in image density which can be caused by surface voltage variations on the photoconductor, even where such voltage variations can be 10 or even 20 percent of the nominal surface voltage. The method of the invention particularly is applicable to color proofers, color copiers, color printers and the like, henceforth referred to in general as color printers. The method, however, also is applicable to black and white or single color processes.

SUMMARY OF THE INVENTION

This invention provides a toning method and member for electrostatography wherein a recording member containing information on its image bearing surface in the form of electrostatic latent images of one polarity is toned by attracting to such latent images toner material of opposite polarity including providing a carrier or toning member according to the invention containing on at least one surface thereof a dry pre-toner coating; activating such pre-toner coating with an insulative solvent to thereby solvate and confer opposite polarity to such pre-toner coating while rendering such pre-toner coating releasable from the carrier member; establishing virtual contact between the activated and releasable pre-toner coating on the carrier member and the image bearing surface of the recording member; transferring the pre-toner coating in image configuration onto the recording member by attraction to the latent images to form toner deposits thereon; and separating the carrier member from the recording member.

DESCRIPTION OF THE PREFERRED EMBODIMENTS

According to the method of this invention there is provided a toning member including a disposable carrier member, for example, paper or the like. The paper is coated on at least one surface thereof with a composition of matter henceforth referred to as "pre-toner". The pre-toner coating can be dried on the carrier member and subsequently, reactivated to function as a liquid toner. The specific method of practicing this invention includes the steps of:

- applying pre-toner coating compositions of desired colors to carrier members, the coating compositions and/or thicknesses being selected to give specific final image densities in a given process;
- drying the coatings;
- rolling up the carrier members to form rolls or cutting the carrier members into sheets and stacking the carrier members or using the carrier members in individual form;
- inserting carrier rolls, or stacks of carrier sheets or individual carrier sheets of the required colors into a color printer operating with a photoconductor on a conductive support and preferably having program actuated means to guide sequentially the appropriate color carriers to the toning position;
- placing a roller adjacent the uncoated side of the carrier member;
- activating the dry pre-toner coating on the carrier member by wetting it and/or the surface of the charged and exposed photoconductor with an insulative liquid prior to toning;
- establishing virtual contact between the photoconductor surface and the activated coating on the carrier member for toning by moving the roller positioned behind the carrier member toward the photoconductor and rolling the carrier member over the entire surface of the photoconductor;

simultaneously while the carrier member is being rolled over the photoconductor surface, applying an appropriate so-called bias voltage of appropriate polarity between the conductive support of the photoconductor and the roller behind the carrier member to tone the photoconductor by transfer to the charged image areas thereon of activated toner from the carrier member;

separating the carrier member from the photoconductor; and disposing of the used carrier member.

In those instances where the photoconductor is in the form of a flat plate, contact with the carrier member for toning can be made, for instance, by rolling the roller behind the carrier member along the photoconductor plate and having the carrier member wrapped around part of the roller circumference. Toning thereby occurs substantially along a line since the carrier member touches the photoconductor simultaneously with the traversing roller and is separated from the photoconductor immediately behind the roller.

In those instances where the photoconductor is in the form of a cylinder which is rotating while being toned, contact with the carrier member can be made, for instance, by moving the roller behind the carrier member toward the cylinder and rotating it at the circumferential speed of the cylinder to thereby cause the carrier member to pass therebetween.

The application of appropriate bias voltage is well known in this art. The terms "appropriate bias voltage" and "appropriate polarity" also cover, of course, those conditions where no voltage is applied or where both the conductive support of the photoconductor and the roller behind the carrier member are grounded or are at the same potential. Instead of applying the bias voltage between the conductive support of the photoconductor and the roller behind the carrier member, it can be applied between the conductive support of the photoconductor and the carrier member itself, provided the carrier member is conductive or semiconductive, or has a conductive or semiconductive coating on its side nearest the roller.

The insulative liquid utilized to activate the pretoner coating on the carrier member can be an isoparaffinic hydrocarbon of the type used in office copiers operating with liquid toners.

The toning method of this invention can be referred to as transfer toning where a toner deposit is transferred under the influence of an electrical field from one surface to another. Such transfer toning virtually is instantaneous, unlike liquid toning where individual toner particles migrate under the influence of the field due to electrophoresis, which is a relatively slow process.

At high toning speed, this invention provides uniform fill-in of solid image areas and virtually no density variation over a print or from print to print. This is because the thickness and/or composition of the pre-toner layer on the carrier member is selected to produce, upon virtually complete transfer to the photoconductor, final images of specific colors and specific densities. Also, the pre-toner composition and/or bias voltage during toning can be selected to effect virtually complete transfer at specific surface voltages to suit various photoconductors. Furthermore, such selection can be made to effect virtually complete transfer at a surface voltage which, for instance, can be 10 or even 20 percent lower than the nominal surface voltage of a specific photoconductor. These surface voltages above such minimum are of no significance because they can not attract any more toner. Thus, density uniformity of the final image depends solely on the coating uniformity of the pre-toner on the carrier member, rather than on process or photoconductor related inconsistencies.

It should be noted, however, that in some processes there is a need for both virtually complete transfer and only partial transfer of the toner layer. Such processes are, for example, color proofing involving halftone imagery, where solid and screened image areas have the same density and virtually complete transfer of the activated toner layer to the photoconductor is needed, and in certain other processes involving continuous tone or grayscale reproduction where the image densities vary and depend on the surface voltage on the exposed photoconductor. This invention is equally applicable in such processes since, by appropriate formulation of the pre-toner coating and/or selection of appropriate bias voltage for toning, it is possible readily to transfer the toner layer virtually completely or to transfer only a part thereof, where the thickness of the layer transferred is determined by the surface voltage on the photoconductor.

The carrier member of the invention preferably is flexible so that it can be rolled up if so desired and wrapped around part of the circumference of the roller effecting contact with the photoconductor during toning. Suitable materials for the carrier member can include, for example, coated and uncoated paper with and without a conductive coating at least on one side thereof, aluminum foil with and without a paper or plastic backing, and plastic sheet with and without a conductive layer. The surface of the carrier member to be coated preferably is smooth to allow good release of the activated layer for transfer toning and to ensure that the final image has a smooth appearance.

The pre-toner coating of the invention preferably is a composition of matter which can be applied as a coating in the form of a liquid resembling paint or printing ink to form a layer on the carrier member. The coating then can be dried to become solid, and some time later, upon activation by wetting with an insulative liquid, can become responsive to attraction by surface charges of a certain polarity. The coating also can produce, by transfer toning, high quality and high resolution imagery identical to that produced by conventional liquid toners in electrophoretic toning.

The main requirements for the pre-toner layer preferably are that it must dry to a smooth finish without shrinkage cracks and that the dry layer must be sufficiently flexible so that it does not crack when the carrier member is rolled up and then sometime later unrolled and when the carrier member is wrapped around part of the roller circumference effecting contact with the photoconductor during toning. Also, the dry layer must be sufficiently firm to withstand rolling up or stacking of the carrier member without being disturbed or damaged by the pressure and shear involved.

It has been determined that many types of transferable liquid toner compositions can be used by incorporation therein of certain substances to meet the requirements for the pre-toner material of the invention.

To produce a pre-toner layer which dries to a smooth finish which is sufficiently flexible yet firm, a plasticizer can be incorporated into the toner composition. The plasticizer preferably is an acrylic copolymer of the film forming so-called convertible or re-solvatable type. Such materials form a flexible film which is non-tacky upon drying and is instantly soluble in an aliphatic or isoparaffinic hydrocarbon. Such acrylic copolymers, in addition to plasticizing or rendering flexible the dry pre-toner layer, also effect adhesion of the layer to the carrier member. They also impart internal cohesiveness to the layer by binding together the toner particles which may be coated with or attached to other materials in the toner composition. Upon activation of the dry pre-toner layer by wetting, such binder becomes instantly solvated whereby adhesion to the carrier member ceases and the internal cohesion of the layer becomes very weak, allowing virtually complete transfer of the toner layer at high resolution.

Response of the activated toner layer to attraction by surface charges on the photoconductor depends mainly on the viscosity or cohesiveness of the wetted layer and on its conductivity. Viscosity and cohesiveness can be adjusted as desired by the type and/or proportioning of the above disclosed acrylic copolymer binder. The conductivity of the layer conveniently can be adjusted by incorporation therein of charge directors or polarity control agents, such as, for instance, metallic soaps and the like. It was determined that an increase in conductivity reduces the sensitivity which means in general that for photoconductors having low surface voltages the conductivity of the layer should be low. The charge director or polarity control agent is selected to be of the type which confers the desired polarity to the toner layer.

The desired density of the final image produced by a virtually completely transferred toner layer in accordance with the method of this invention is obtained by coating the pre-toner layer to the appropriate thickness and/or incorporating in the pre-toner composition the pigment or coloring material in the appropriate proportion.

In those instances where virtually complete transfer of the toner layer to the photoconductor is needed, such as in halftone imagery, it is preferable to apply a release coating to the carrier member prior to coating it with pretoner. Such a release coating may comprise, for instance, a silicone compound or a fine dispersion of silica with a small proportion of a binder material in alcohol, and the like.

As stated above, uniformity of the final image density produced in accordance with this invention depends on the uniformity of the pre-toner layer on the carrier member. Therefore, it is essential to coat the carrier member with the pre-toner material by methods which can be precisely controlled. Since the viscosity of the pre-toner material readily can be adjusted, for instance by the proportion of the solvent used for the acrylic copolymer plasticizer/ binder, various known and precisely controllable coating methods can be used. These methods can include reverse roll, knife and dip coating, electrostatic deposition, as well as gravure, flexographic and offset printing and the like.

The pre-toner composition comprising coloring matter, binder, plasticizer, charge control agent and solvent can be prepared by blending these materials and then placing the thus formed mixture into a dispersing device, such as a ball mill, high speed mixer, attritor, roll mill, and the like.

The coloring matter may include organic and inorganic pigments and organic dyes.

The binder may include acrylic polymers and copolymers, styrene polymers and copolymers, natural resins, esters of rosin, synthetic rubber, and the like.

The plasticizer may include formaldehyde resins, abietates, ether resins, acrylic polymers and copolymers, alkyd resins, vinyl resins, and the like.

It should be noted that both the binder and plasticizer material should be compatible with each other in the dissolved state and they should be so selected that they form a pre-toner coating which upon drying is non-tacky, flexible, cohesively relatively weak and instantly solvated or loosened upon activation or wetting with the chosen insulating liquid.

The charge control agent can be of the type well known in the art, such as for instance a metallic soap for imparting positive polarity to the pre-toner composition.

The solvent is selected with regard to the solubility of the binder and plasticizer used and may include aliphatic and aromatic hydrocarbons, ketones, halogenated solvents, alcohols, and the like.

In general the ratio of the binder/plasticizer to coloring matter can be in the range from about 1:2.5 to 9:1 by weight. The exact ratio will depend on the nature of the materials used, including, for instance, the color strength or hiding power of the coloring matter and the final image density required.

The proportion of solvent used will depend mainly on the viscosity required for a specific coating method chosen and the thickness of the wet coating which is to be applied. It was determined that by the reverse roller coating method, for instance, very uniform dry coatings in the thickness range of 2 to 8 microns could be obtained with a corresponding wet coating thickness in the range of about 10 to 50 microns, the proportion of solvent to the other materials in the pre-toner coating being in the range 1.5:1 to 9:1 by weight.

The following Examples are included to further illustrate this invention.

Example 1

A cyan color pre-toner coating was prepared with the following composition:

| | |
|---|---|
| Phthalocyanine pigment, Pigment Blue 15.3 | 100 grams |
| Vinyl toluene methacrylate copolymer (binder) | 50 grams |
| Toluene sulphonamide formaldehyde resin (plasticizer) | 5 grams |
| Manganese naphthenate, 4% metal, (positive charge control agent) | 5 grams |
| Toluene (solvent) | 500 grams |

The above materials were blended, placed in a one liter ball jar and milled for 48 hours.

The carrier member for the pre-toner comprised smooth clay coated art paper, 80 grams per square meter (gsm) weight, coated on one side to approximately 0.5 gsm weight with a silicone polymer release agent Dow Corning 30 (TM) manufactured by Dow Corning Corporation, Michigan, U.S.A.

The milled composition was reverse roller coated onto the side of the carrier member containing the release layer to a wet coating thickness of about 25 microns, which upon drying resulted in a dry pre-toner coating having a thickness of about 5 microns.

A commercially available zinc oxide/binder photoconductor coated copier type paper was used as the recording member. The photoconductor was electrostatically charged negatively and exposed to a light pattern, after which the surface voltage was measured and was determined to be in the range of 380-420 Volts negative in the latent image areas corresponding to solid density.

The latent image bearing surface of the recording member was wetted with Isopar G (TM). It was then brought into contact with the pre-toner coating on the carrier member and the thus formed sandwich was passed at a speed of 12cm/second between a pair of rollers set at a light pressure just sufficient to maintain uniform virtual contact between the recording member and the carrier member.

Each roller comprised a metal shaft coated with conductive rubber. The roller located behind the recording member was grounded, whereas the roller behind the pre-toner coated carrier had a forward bias voltage of 150 Volts positive applied thereto to assist transfer of the pre-toner coating having positive polarity upon activation.

Immediately upon emergence from the rollers, the recording member was separated from the pre-toner carrier member and it was determined that the pre-toner coating had transferred virtually completely to the latent image areas on the recording member forming toner deposits thereon.

Such toner deposits on the recording member were measured upon drying with a Macbeth reflection densitometer and showed remarkably uniform density in the range 1.60 to 1.62 ODU (optical density units), despite the relatively large variation in the surface voltage.

Example 2

A yellow color pre-toner coating was prepared with the following composition:

| | |
|---|---|
| Diaryl pigment, Pigment Yellow 83 | 50 grams |
| Alpha methyl styrene polymer (binder) | 100 grams |
| Methyl abietate (plasticizer) | 15 grams |
| Zirconium octoate, 12% metal (positive charge control agent) | 10 grams |
| Isopar G TM (solvent) | 500 grams |

The materials were blended, milled and coated onto a carrier member as in Example 1. The thickness of the wet coating was about 70 microns, which upon drying resulted in a dry pre-toner coating having a thickness of about 6 microns.

The carrier member with the pre-toner coating was used as in Example 1.

The density of the dry yellow deposits on the recording member was in the remarkably narrow range of 1.62 to 1.65 ODU.

Example 3

A magenta color pre-toner coating was prepared with the following composition:

| | |
|---|---|
| Calcium 4B pigment, Pigment Red 57.1 | 50 grams |
| Glycerol ester of hydrogenated rosin (binder) | 25 grams |
| Polyvinyl ethyl ether (plasticizer) | 5 grams |
| Cupric naphthenate, 4% metal (positive charge control agent) | 5 grams |
| Toluene (solvent) | 500 grams |

The materials were blended, milled and coated onto a carrier member as in Example 1. The thickness of the wet coating was about 60 microns, which upon drying resulted in a dry pre-toner coating having a thickness of about 3 microns.

The carrier member with the pre-toner coating was used as in Example 1.

The density of the dry magenta deposits on the recording member was in the narrow range of 1.56 to 1.59 ODU.

Example 4

Example 1 was repeated with the exception that the thickness of the wet pre-toner coating was about 15 microns, which resulted in a dry coating thickness of about 3 microns.

The density of the dry cyan toner deposits on the recording member was in the narrow range of 1.30 to 1.33 ODU.

Example 5

Example 2 was repeated with the exception that the thickness of the wet pre-toner coating was about 40 microns, which resulted in a dry coating thickness of about 4 microns.

The density of the dry yellow toner deposits on the recording member was in the narrow range of 1.42 to 1.44 ODU.

Example 6

Example 3 was repeated with the exception that the thickness of the wet pre-toner coating was about 30 microns, which resulted in a dry coating thickness of about 2 microns.

The density of the dry magenta toner deposits on the recording member was in the narrow range of 1.25 to 1.28 ODU.

Example 7

Example 1 was repeated with the exception that the quantity of the Phthalocyanine pigment was reduced from 100 grams to 80 grams.

The thicknesses of the wet and dry pre-toner coatings were substantially the same as in Example 1.

The density of the dry cyan toner deposits on the recording member was in the narrow range of 1.45 to 1.47 ODU.

Example 8

Example 2 was repeated with the exception that the quantity of the Diaryl pigment was reduced from 50 grams to 40 grams.

The thicknesses of the wet and dry pre-toner coatings were substantially the same as in Example 2.

The density o±the dry yellow toner deposits on the recording member was in the narrow range of 1.15 to 1.17 ODU.

Example 9

Example 3 was repeated with the exception that the quantity of the Calcium 4B pigment was reduced from 50 grams to 40 grams.

The thicknesses of the wet and dry pre-toner coatings were substantially the same as in Example 3.

The density of the dry magenta toner deposits on the recording member was in the narrow range of 1.28 to 1.31 ODU.

Examples 10–18.

Examples 1 - 9 were repeated with the exception that the toner deposits formed on the recording member were not dried but were transferred therefrom by the well known electrostatic transfer method onto a receptor comprising a sheet of clay coated art paper.

Upon drying on the receptor, the densities of the toner deposits were measured with the Macbeth reflection densitometer.

The cyan toner deposits of Examples 1, 4 and 7 and the magenta toner deposits of Examples 3, 6 and 9 showed a density decrease of about 0.04 ODU caused by a slight residue remaining on the recording member, whereas the yellow toner deposits of Examples 2, 5 and 8 showed a decrease of only about 0.02 ODU. Uniformity was excellent, same as in Examples 1–9.

Examples 19–21.

Examples 1–3 were repeated with the exception that when passing the sandwich through the pair of rollers both rollers were held at ground potential.

Transfer of pre-toner coating to the latent image areas on the recording member was not complete and residues in the range of 0.12 to 0.20 ODU were measured on the carrier member.

The densities of the toner deposits transferred onto the recording member were proportionally decreased. Also, uniformity was slightly decreased since the density ranges as given in Examples 1, 2 and 3 were determined to have widened by about 0.02 ODU average in each case.

Examples 22–24

Examples 1–3 were repeated with the exception that the art paper carrier member for the pre-toner coating did not contain a release layer.

Transfer of pre-toner coating to the latent image areas on the recording member was not complete and residues of about 0.15 ODU average were measured on the carrier member.

The densities of the toner deposits transferred onto the recording member were proportionally decreased. Also, uniformity was decreased since the density ranges as given in Examples 1, 2 and 3 were determined to have widened by about 0.05 ODU average in each case.

Isopar G (TM) in the above Examples is an isoparaffinic hydrocarbon, boiling range 155–173 deg.C, manufactured by the Exxon Corporation, USA.

Toluene in the above Examples is an aromatic hydrocarbon, boiling range 110–111 deg. C.

It should be noted that throughout the above Examples for simplicity of comparison we have used commercially available zinc oxide/binder photoconductor coated paper as the recording member. Equally uniform toner deposits, however, were produced with the compositions and methods given in the Examples on other recording members, such as organic photoconductors, selenium, cadmium sulphide, amorphous silicon, and the like. Such results also were produced on recording members comprising commercially available dielectric paper as used in plotters operating with liquid toners where the latent image is formed by charging the dielectric paper in image configuration by styli or other corona or ion generating means.

For the same reason, throughout all of the above Examples the carrier member for the pre-toner coating comprised smooth clay coated art paper and it will be realized that other materials having a smooth surface are equally suitable as carrier members. As has been stated earlier, such materials include plain paper, paper or plastic film with a conductive coating, aluminum foil preferably laminated onto paper or plastic film, and the like. The bias voltage applied between the recording member and the pre-toner carrier member will have to be optimized from case to case as it will depend not only on the surface voltage of the recording member in latent image areas and on the pre-toner composition, but also on the nature of the pre-toner carrier member, mainly in relation to the thickness and electrical conductivity thereof.

Furthermore, again for simplicity of comparison, in Examples 10–18 the toner deposits formed on the recording member were transferred therefrom onto the receptor by electrostatic methods. Other methods of transfer, however, such as by means of heat and/or pressure are equally applicable.

It should be realized that the method of this invention also can provide an image reversal process, that is, production of a positive image from a negative film or negative color separation film. This is because if a negative film is used to expose the photoconductor, the toner transferred to the photoconductor will form a negative image thereon, while the residue on the carrier member will form a positive image. The thus formed positive image then can be transferred from the carrier member to a receptor, and, if residues of appropriate colors are sequentially transferred from the respective carriers to a printing stock paper receptor, a positive color proof can be produced from negative color separation films.

There has been disclosed a novel method of very fast toning whereby high quality imagery can be produced with virtually no density variation caused by photoconductor or process related inconsistencies. The method is particularly applicable to electrostatographic color printing. The description given herein of the method as carried out and of the materials useful in the method is intended to be construed in an illustrative sense without restricting the scope of this invention.

We claim:

1. A toning method for electrostatography wherein a recording member containing information on its image bearing surface in the form of electrostatic latent images of one polarity is toned by attracting to such latent images toner material of opposite polarity, comprising the steps of:

providing a carrier member having on at least one surface thereof a dry pre-toner coating;

activating said pre-toner coating with an insulative solvent to thereby solvate and confer opposite polarity to said pre-toner coating while rendering said pre-toner coating releasable from said carrier member;

establishing virtual contact between said activated and releasable pre-toner coating on said carrier member and the image bearing surface of said recording member;

transferring said pre-toner coating in image configuration onto said recording member by attraction to said latent images to form toner deposits thereon; and separating said carrier member from said recording member.

2. The method as defined in claim 1 wherein said step of providing a carrier member includes providing a carrier member having on at least one surface thereof a dry pretoner coating essentially including coloring matter, binder, plasticizer and an opposite polarity charge control agent.

3. The method as defined in claim 1 wherein said insulative solvent is applied to the latent image bearing surface of said recording member to activate said pre-toner coating prior to establishing virtual contact therebetween.

4. The method as defined in claim 1 wherein said insulative solvent is applied to said pre-toner coating to activate said pre-toner coating prior to establishing virtual contact between the image bearing surface of said recording member and the said pre-toner coating.

5. The method as defined in claim 1 wherein said insulative solvent used to activate said pre-toner coating is an isoparaffinic hydrocarbon.

6. The method as defined in claim 1 including applying said pre-toner coating over a release layer contained on said carrier member.

7. The method as defined in claim 1 including applying a bias potential during established virtual contact between said latent image bearing surface of said recording member and said activated pre-toner coating on said carrier member.

8. A toner member for toning electrostatic latent images of one polarity on a recording member comprising:

a carrier member having a dry, nonactivated pre-toner coating of controlled uniform thickness on a surface thereof, said coating adapted to be activated by a selective insulative solvent capable of rendering the polarity at said coating opposite to that of the recording member and releasing said coating from said carrier so that upon face-to-face contact of said coating and said recording member said activated coating can be transferred to said recording member.

9. The toning member as defined in claim 8 wherein said solvent is an isoparaffinic hydrocarbon.

10. The toning member as defined in claim 8 wherein said carrier member includes a release layer over which said coating is applied.

11. The toning member as defined in claim 8 wherein said pre-toner coating essentially includes coloring matter, a binder, a plasticizer and a polarity charge control agent.

12. The toning member as defined in claim 11 wherein said plasticizer is a re-solvatable acrylic copolymer which provides binding of toner particles and adhesion of the pretoner layer to the carrier member while maintaining the flexibility of the pre-toner layer.

13. The toning member as defined in claim 8 wherein said carrier member is flexible having a smooth surface.

14. The toning member as defined in claim 13 wherein said carrier member is paper.

15. The toning member as defined in claim 14 wherein said paper includes a conductive coating on at least one surface thereof.

16. The toning member as defined in claim 13 wherein said carrier member is aluminum foil.

17. The toning member as defined in claim 16 wherein said aluminum foil includes at least one of a paper backing and a plastic backing.

18. The toning member as defined in claim 13 wherein said carrier member is a plastic sheet.

19. The toning member as defined in claim 18 wherein said plastic sheet includes a conductive coating on at least one surface thereof.

20. The toning member as defined in claim 13 wherein said pre-toner layer is capable of drying to a smooth finish without shrinkage cracks and is sufficiently flexible, dry and firm to resist cracking upon flexing of said carrier member and to resist pressure and shear involved in rolling or stacking of the carrier member.

* * * * *